United States Patent [19]

Eberle

[11] 4,067,422

[45] Jan. 10, 1978

[54] ATTACHE CASE WITH AUXILIARY ACCESS OPENING

[76] Inventor: Robert A. Eberle, 5585 E. Pacific Coast Highway, Apt. 324, Long Beach, Calif. 90804

[21] Appl. No.: 797,075

[22] Filed: May 16, 1977

[51] Int. Cl.[2] ..... A45C 3/02

[52] U.S. Cl. ..... 190/41 R; 150/1.6

[58] Field of Search ..... 190/41 R, 48, 52; 150/1.6; 220/254; 232/1 R, 43.1, 47

[56] References Cited

U.S. PATENT DOCUMENTS

| | | | |
|---|---|---|---|
| 1,424,519 | 8/1922 | Richardson | 220/254 |
| 2,213,821 | 9/1940 | McCurdy | 190/52 UX |
| 2,800,244 | 7/1957 | Witt | 220/254 |
| 3,912,055 | 10/1975 | Malooly | 190/52 |
| 4,014,416 | 3/1977 | Golden | 190/42 |

*Primary Examiner*—Donald F. Norton

*Attorney, Agent, or Firm*—Buckles and Bramblett

[57] ABSTRACT

An attache case having a slot through one of its walls closed by a spring-loaded internal shutter. Articles may thereby be placed into the attache case without opening the main lid.

6 Claims, 3 Drawing Figures

ATTACHE CASE WITH AUXILIARY ACCESS OPENING

BACKGROUND OF THE INVENTION

It is often desired to place articles in an attache or luggage case after the case has been closed. For example, the businessman leaving his office with an attache case may be handed correspondence by his secretary or a train or subway commuter may finish a magazine. In each instance, when carrying a standard attache case, the owner must go through the trouble of unlatching and opening the main lid to insert the article. The operation requires the use of two hands and, usually, a flat surface to prevent spillage of the case contents. Not only is this inconvenient, but it also discloses the contents to the eyes of others. Prior efforts to resolve this problem have not been notably successful. Examples of the prior art include U.S. Pat. Nos. 2,213,821 and 3,912,055. In the devices disclosed in both of these patents, some portion or all of a sidewall is hinged to be opened outwardly. These "solutions" are really not much of an improvement over the usual process of simply opening the main lid. Other art known to the applicant but not particularly relevant to the present invention includes U.S. Pat. Nos. 1,561,351 and 4,014,416.

It is a primary object of the present invention to provide an attache or similar case within which articles may be easily inserted while the case remains closed. Another object is to provide such a case wherein insertion of an article may be easily accomplished whether the bearer is sitting or standing. Another object is to provide such a case wherein insertion of the article does not disclose the contents to others. Other objects, features and advantages will become apparent from the following description and appended claims.

SUMMARY OF THE INVENTION

An improvement in an attache case which includes a body portion and a hinged lid secured thereto. A slot is defined through the case from its exterior to its interior. Closure means are hingedly secured to the interior of the case for movement between slot closing and slot opening positions. The closure means is resiliently biased into its slot closing position.

DESCRIPTION OF THE PREFERRED EMBODIMENT

Figure 1:
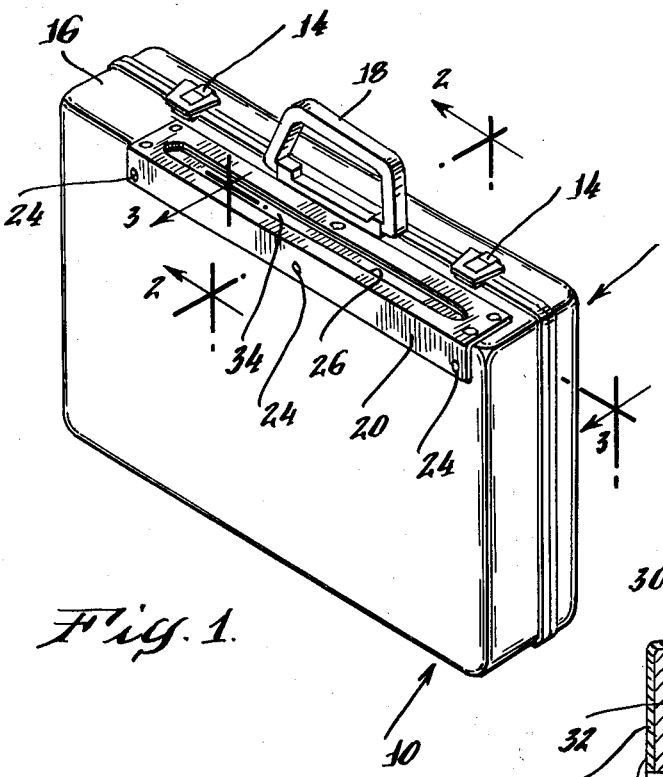
FIG. 1 is a perspective view of an attache case constructed in accordance with this invention.

Referring to the drawing, there is illustrated therein an attache case comprising a body portion 10 and a lid 12 secured thereto in the usual fashion by a hinge (not shown) running along the bottom of the case as viewed in FIG. 1. The lid 12 is releasably secured to the body 10 by means of conventional latches 14 between the lid and the top wall 16 of body 10. The usual handle 18 is mounted to the top wall 16. It will be understood that the body 10 and lid 12 may be constructed of any suitable materials, such as plastic, metal, leather, etc.

In the illustrated embodiment outer 20 and inner 22 aluminum angles (FIG. 2) are mounted along the upper edge of the body portion 10. The angles are secured to body portion 10 and to each other by means of rivets 24 which extend through the intervening sidewall and top wall 16 of the body of the attache case. Those portions of the outer 20 and inner 22 aluminum angles which overlie the top wall 16 define respective, aligned, slots 26, 28. The top wall 16 also defines an aligned slot 30 therebetween. Mounted against the inner surface of inner angle 22 by means of a piano-type hinge 32 is an elongated shutter 34 which is movable between a slot closing position illustrated in solid lines and a slot open position as illustrated in dashed-dotted line of FIG. 2. A coil spring 36 is mounted on the hinge 32 with two end legs **36*a*, 36*b* being positioned against the inner angle 22 and the shutter 34** to maintain the shutter in its normally closed position.

Figure 2:
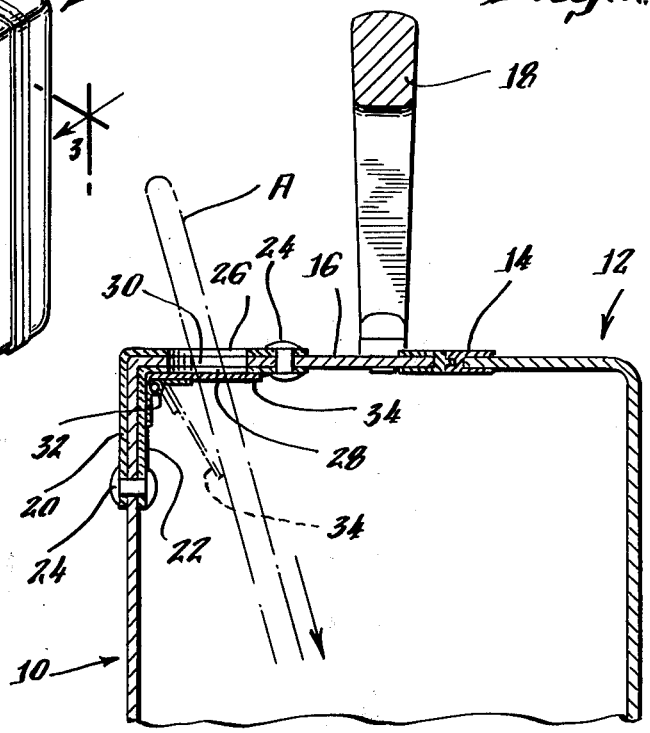
FIG. 2 is an enlarged partial cross section taken substantially along the line 2—2 of FIG. 1.
Figure 3:
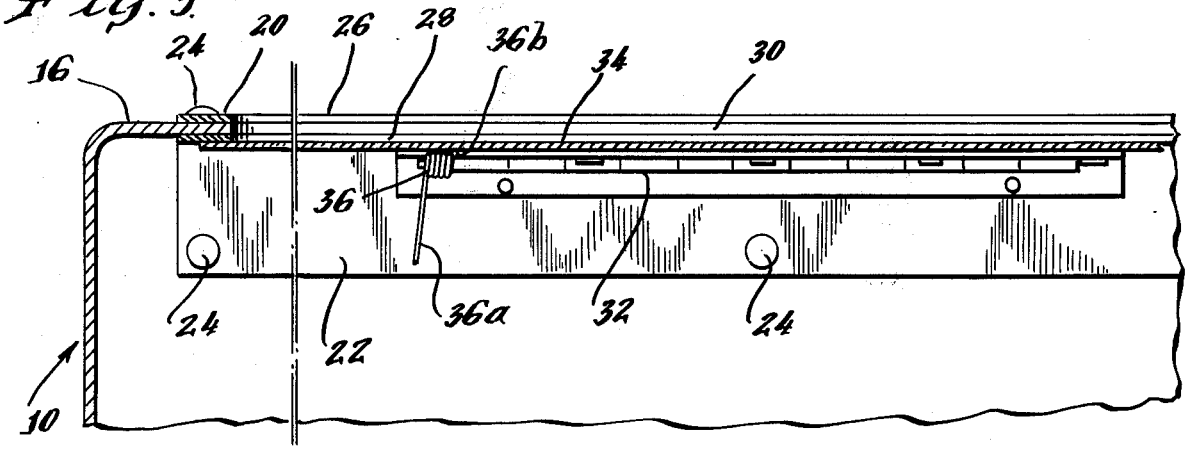
FIG. 3 is an enlarged partial cross section taken substantially along the line 3—3 of FIG. 1.

It is believed that the advantages of this invention will be apparent to those skilled in the art. For example, by means of this invention, it is possible to insert mail, magazines, or the like into the case, as shown in FIG. 2, wherein the article A is shown as forcing open the spring-loaded shutter 34 so as to fall into the bottom of the case. It is not necessary to fumble with latches, to use more than one hand, or to position the case so as not to spill its contents. Furthermore, the contents of the case are not revealed when an article is inserted through the slot. If desired, the shutter 34 might be locked in place by any suitable latching means.

It will also be apparent that, although the case is illustrated as having a pair of reinforcing angles 20, 22, the shutter assembly may be otherwise installed. It might, for example, be molded into a plastic case during the molding operation or otherwise built into the body or lid during construction. As illustrated in FIG. 1, the slot 26 is shown as positioned slightly to the right of the center line of the case. This might be preferred for a righthanded user carrying the case in his left hand with the near side toward the body. The slot would then be most accessible for insertion of articles with the right hand. However, it will be understood that the slot might actually be placed in any position on the body or lid. Furthermore, the described construction is not necessarily limited to an attache case but may also be incorporated into other types of luggage or brief cases.

In addition to the foregoing, it will be understood by those skilled in the art that a number of variations and modifications may be made in this invention without departing from its spirit and scope. Accordingly, the foregoing description is to be construed as illustrative only, rather than limiting. This invention is limited only by the scope of the following claims.

What is claimed is:

1. In a luggage case including a body portion, a hinged lid secured thereto, and a handle, the improvement which comprises: means defining a slot through said case from its exterior to its interior; closure means hingedly secured to the interior of said case for movement between slot-closing and slot-opening positions; and means for resiliently biasing said closure means into its slot-closing position.

2. The improvement of claim 1 wherein said closure means comprises an elongated shutter plate.

3. The improvement of claim 1 wherein said biasing means comprises a spring.

4. The improvement of claim 1 wherein said slot is defined by a case wall portion adjacent said handle.

5. The improvement of claim 4 wherein said closure means comprises an elongated shutter plate.

6. The improvement of claim 5 wherein said biasing means comprises a spring.

* * * * *